US006619293B1

(12) United States Patent
Siadto

(10) Patent No.: US 6,619,293 B1
(45) Date of Patent: Sep. 16, 2003

(54) TOBACCO ALTERNATIVE

(76) Inventor: Modesto E. Siadto, 10011 Whitefield St., Fairfax, VA (US) 22032

( * ) Notice: Subject to any disclaimer, the term of this patent is extended or adjusted under 35 U.S.C. 154(b) by 0 days.

(21) Appl. No.: 10/198,366

(22) Filed: Jul. 19, 2002

(51) Int. Cl.[7] ..... A24B 15/12
(52) U.S. Cl. ..... 131/369; 131/359
(58) Field of Search ..... 131/369, 359, 131/352, 347, 360; 426/597

(56) References Cited

U.S. PATENT DOCUMENTS

| | | | |
|---|---|---|---|
| 4,694,842 | A | 9/1987 | Kobayashi |
| 4,811,746 | A | 3/1989 | Davis |

FOREIGN PATENT DOCUMENTS

| | | | |
|---|---|---|---|
| CN | 1081339 | | 2/1994 |
| CN | 1086979 | | 5/1994 |
| CN | 1100610 | | 3/1995 |
| CN | 1134800 | | 11/1996 |
| CN | 1137362 | | 12/1996 |
| CN | 1142926 | | 2/1997 |
| CN | 1155402 | | 7/1997 |
| CN | 1206569 | | 2/1999 |
| CN | 1223828 | | 7/1999 |
| CN | 1250631 | | 4/2000 |
| CN | 1253753 | | 5/2000 |
| CN | 1322481 | | 11/2001 |
| DE | 19719859 | | 11/1998 |
| JP | 1-141579 | * | 6/1989 |
| WO | WO 83/02879 | * | 9/1983 |

OTHER PUBLICATIONS

Belitz, H.D. and Grosch, W., *Food Chemistry*, 2nd ed., Springer–Verlag, Berlin 1999, pp. 886–893.
Pettigrew, J., *The Tea Companion*, Macmillan, New York, 1997, pp. 30–39.

* cited by examiner

*Primary Examiner*—Steven P. Griffin
*Assistant Examiner*—Dionne A. Walls
(74) *Attorney, Agent, or Firm*—Richard C. Litman

(57) ABSTRACT

An alternative to tobacco for both smokers and chewers is provided. A cigarette is prepared from mature tea leaves which are steamed and dried, but not withered, roasted or fermented. The tea leaves are rolled in paper and may be filtered or non-filtered. Cigarettes prepared with tea leaves processed in this manner provide acceptable taste, and may provide natural antioxidants, such as polyphenols and flavonoids, by inhalation. A chaw prepared according to the present invention is made with tea leaves which have been roasted, but not fermented, and is flavored with vanilla, cinnamon or mint. Both products may be produced with natural caffeine content, or may be partially decaffeinated.

5 Claims, No Drawings

TOBACCO ALTERNATIVE

BACKGROUND OF THE INVENTION

1. Field of the Invention

The present invention relates to a substance which serves as an alternative to tobacco in cigarettes and in chaws, and particularly to fresh tea cigarettes and a method of making the same used as an alternative for cigarettes made from tobacco, and to a flavored chewing tea used as an alternative for chewing, tobacco.

2. Description of the Related Art

The hazards of tobacco are well documented. Smoking tobacco cigarettes greatly increases the risk of cancers, especially lung cancer. In addition, several impairments other than lung cancer have been linked to smoking tobacco products, including pulmonary emphysema, heart attacks, etc. Using tobacco as a chew is not without hazards. Tobacco chewers frequently develop oral cancer. For years, inventors have sought tobacco substitutes which are less hazardous and less expensive. Unfortunately, prior inventions have not been well received by tobacco consumers. A good alternative would at least have two relevant tobacco properties: stimulant and robust flavor. Additional desirable properties would be low cost and health enhancing benefits.

Regular, non-herbal drinking tea is made from the *Camellia Sinensis* plant. All drinking teas preferably use young tea leaves. The younger the tea leaves, the better the quality of drinking tea. Teas are generally classified into type by the steps used in processing the tea leaves. Black tea is processed by withering the tea leaves, then conditioning the tea leaves to distribute the enzymes on the tea leaves, rolling the leaves, fermenting the leaves (allowing the leaves to undergo enzymatic oxidation), and firing the leaves. Green teas are prepared without withering and without fermentation in order to prevent oxidation of various polyphenol and flavonoid constituents, and may be prepared according to the Japanese method (steaming and drying, followed by rolling and firing), or by the Chinese method (roasting, followed by rolling and firing). Various intermediates (yellow and red teas) are prepared by omitting or modifying various steps (yellow tea is not fermented, but is withered, roasted, and fired; red tea [Oolong] is partially fermented) used in preparing black and green, teas. White tea is made from buds which are plucked before they open, and then steamed and dried. White tea takes its name from the silver-white hairs on the new buds and tender young leaves. The types and grades of tea and processing methods are described in *Food Chemistry*, 2nd ed., H. D. Belitz and W. Grosch, Springer, 1999, pp. 886–893, and in *The Tea Companion*, J. Pettigrew, Macmillan, 1197, pp. 30–39.

U.S. Pat. No. 4,694,842, issued on Sep. 22, 1987 to K. Kobayashi, describes a smoking product consisting essentially of a mixture of tobacco leaves, green tea leaves, chrysanthemum flowers, and Cnidii Rhizoma. The mixture is tumbled in a drum to make a fibrous mixture, then fermented, and then dried. Because fermentation oxidizes phenols, this method of manufacture is likely to destroy most of the health enhancing phenols found in fresh tea leaves.

U.S. Pat. No. 4,811,746, issued on Mar. 14, 1989 to L. J. Davis, describes a substitute for oral smokeless tobacco made by applying a binding agent that includes flour to tea (e.g., peppermint leaf herbal tea) fragments.

German Pat. No. 19,719,859, published on Nov. 19, 1998, describes a substitute for tobacco snuff that is inhaled through the nose. The snuff can be made from tea and other stimulating substances.

None of the above inventions and patents, taken either singularly or in combination, is seen to describe the instant invention as claimed.

SUMMARY OF THE INVENTION

The present invention provides an alternative to tobacco for both smokers and chewers. A cigarette prepared according to the present invention is prepared from mature tea leaves which are steamed and dried, but not withered, roasted or fermented. The tea leaves are rolled in paper and may be filtered or non-filtered. Cigarettes prepared with tea leaves processed in this manner provide acceptable taste, and may provide natural antioxidants, such as polyphenols and flavonoids, including catechins, by inhalation. A chaw prepared according to the present invention is made with tea leaves which have been roasted, but not fermented, and is flavored with vanilla, cinnamon or mint.

Because tea contains fluoride, tea prepared according to the present invention may prevent cavities and bad breath. Both products, tea cigarettes and chew, may be produced with natural caffeine content, or may be partially decaffeinated.

Accordingly, it is a principal object of the invention to make a tobacco alternative that produces a stimulating effect without the use of nicotine.

It is another object of the invention to make a tobacco alternative that retains the healthy promoting compounds found in fresh tea leaves.

A further object of the invention is to describe a method of making cigarettes with tea leaves that results in a product which produces acceptable taste when smoked, while avoiding the harmful health effects associated with tobacco smoking.

Yet another object of the invention is to provide a strong tasting alternative to chewing tobacco.

Still another object of the invention is to provide an alternative to tobacco smoking and chewing products which is affordable, safe, and that is completely devoid of nicotine.

It is an object of the invention to provide improved elements and arrangements thereof for the purposes described which is inexpensive, dependable and fully effective in accomplishing its intended purposes.

These and other objects of the present invention will become readily apparent upon further review of the following specification.

DETAILED DESCRIPTION OF THE PREFERRED EMBODIMENTS

The present invention is a tobacco alternative and the methods for making the same. The tobacco alternative may take the form of a cigarette for smoking, or a chaw for chewing.

Fresh tea cigarettes are made from fresh tea leaves. Mature tea leaves are harvested and then immediately steamed to prevent the leaves from fermenting. Stopping the fermentation process results in tea leaves with a higher polyphenol content than fermented tea leaves, since steaming the tea leaves destroys the enzymes which result in oxidation of polyphenols, flavonoids, tannins, and other beneficial substances during fermentation. Steaming makes the leaves pliable, rather than crumbly and dry, as occurs with roasting, for later processing steps, and results in better taste when smoked. The leaves are then dried. Tea leaves used in preparing cigarettes according to the present invention may be sorted either during harvesting or after drying to ensure that mature tea leaves are selected, and that buds and shoots are rejected. This differs from tea prepared for drinking, in which buds, shoots, and young tender leaves are preferred. It is important to use leaves of sufficient size so that the tea stays inside the cigarette rather than falling out of it during manufacture and consumer use. Additionally, young leaves and shoots contain more caffeine.

In order to manufacture the tea cigarettes, the dried tea leaves are moistened with water for a few hours. Moistening makes the leaves more pliable to ensure uniform cutting of the leaves in the cutting machine. Next, the moistened leaves are flattened with a roller to produce thinner leaves having more uniform thickness for faster burning. If flavored tea cigarettes are desired, then the tea leaves are sprayed with a liquid flavoring agent. Vanilla, cinnamon, and mint are particularly pleasant flavors for tea cigarettes. The flattened leaves are cut into strips or shredded. A conventional tobacco cutting machine may be used. Next, the tea strips are air dried under controlled environmental conditions.

The dried teas trips are rolled in paper to form a cigarette. A conventional tobacco cigarette machine may be used for this processing step since the shredded tea is very similar in handling properties to cigarette tobacco. If desired, a cigarette smoking filter is added during the rolling step.

Partially decaffeinated cigarettes can be made by decaffeinating the tea. The tea can be decaffeinated by passing boiling water through the dried tea leaves before they are cut into strips. Other methods of decaffeination can be used, but this water method avoids the use of toxic chemicals.

An edible alternative to smokeless tobacco is made by mixing green tea with a pungent flavoring agent. Green tea as used for preparing chaws is preferably green tea which is roasted, not steamed. Green tea pellets are the easiest tea to use. Tablespoonfuls of the mixture are wrapped in airtight foil to preserve their freshness and flavor. The green tea pellets are treated with a natural extract, such as either pungent pepper, cinnamon, natural orange extract, natural mint extract, honey, or a hot sauce to make a flavorful product. Salt was found to be a poor flavoring agent since its flavor was too weak. Since the tea and the flavoring agents are natural, the product may be swallowed or spit out.

It is to be understood that the present invention is not limited to the embodiments described above, but encompasses any and all embodiments within the scope of the following claims.

I claim:

1. A method of making a fresh tea cigarette with therapeutic properties, comprising the sequential steps of:

(a) harvesting a plurality of tea leaves containing buds and shoots;

(b) immediately after step (a), steaming the tea leaves;

(c) drying the tea leaves;

(d) sorting the tea leaves by removing the buds and shoots to provide mature tea leaves;

(e) flattening the mature tea leaves;

(f) cutting the mature tea leaves into strips or shredding the mature tea leaves into shreds; and (g) rolling the strips or shreds of mature tea leaves into a combustible material to form a cigarette.

2. The method of claim 1, further comprising the step of attaching a filter to the cigarette.

3. The method of claim 1, further comprising the step of spraying the strips or shreds of mature tea leaves with at least one flavoring agent.

4. The method according to claim 3, wherein said flavoring agent is selected from the group consisting of vanilla, cinnamon, and mint.

5. A method of making a fresh tea cigarette with therapeutic properties, comprising the steps of:

(a) harvesting a plurality of tea leaves containing buds and shoots;

(b) immediately after step (a), steaming the tea leaves;

(c) drying the tea leaves;

(d) sorting the tea leaves by removing the buds and shoots to provide mature tea leaves;

(e) flattening the mature tea leaves;

(f) cutting the mature tea leaves into strips or shredding the mature tea leaves into shreds;

(g) passing boiling water through the tea leaves after step (c) but before step (f) in order to at least partially decaffeinate the tea leaves; and (g) rolling the strips or shreds of mature tea leaves into a combustible material to form a cigarette.

* * * * *